United States Patent [19]

Kovacic et al.

[11] 4,452,670

[45] Jun. 5, 1984

[54] METHOD AND APPARATUS FOR RECOVERING PREHEATER COAL FINES

[75] Inventors: Joseph E. Kovacic; Michael Perch; Bernard R. Kuchta, all of Pittsburgh, Pa.

[73] Assignee: Koppers Company, Inc., Pittsburgh, Pa.

[21] Appl. No.: 157,364

[22] Filed: Jun. 9, 1980

Related U.S. Application Data

[63] Continuation of Ser. No. 926,512, Jul. 20, 1978, abandoned.

[51] Int. Cl.[3] ..... C10B 31/00; C10B 57/08; C10B 57/10

[52] U.S. Cl. ..... 201/6; 201/8; 201/23; 201/41; 201/42; 202/82; 202/262; 202/263

[58] Field of Search ..... 201/5, 6, 8, 9, 23, 201/25, 42, 41; 23/314, 313 R; 264/118, 144, 175; 202/82, 262, 263

[56] References Cited

U.S. PATENT DOCUMENTS

| | | | |
|---|---|---|---|
| 2,556,154 | 6/1951 | Kern | 201/6 |
| 3,619,376 | 11/1971 | Patel et al. | 201/6 |
| 3,992,266 | 11/1976 | Aktay et al. | 201/8 |
| 4,082,515 | 4/1978 | Capes et al. | 201/6 |
| 4,142,941 | 3/1979 | Weber et al. | 201/6 |
| 4,186,054 | 1/1980 | Brayton et al. | 201/8 |

*Primary Examiner*—Bradley Garris

*Attorney, Agent, or Firm*—Thomas L. Sivak; Herbert J. Zeh, Jr.

[57] ABSTRACT

Coal fines developed from the processing of coal through a preheating system are accumulated in a secondary cyclone system. The coal fines, at an elevated temperature, are mixed with a hydrocarbon organic binder and compressed into larger particles of sufficient structural integrity and mass to be fed directly through pneumatic pressure coke oven coal charging lines without significant size reduction, resulting in the elimination of fine coal build-up in one coke oven standpipes and charging mains as well as overloading of the charging liquor system.

14 Claims, 1 Drawing Figure

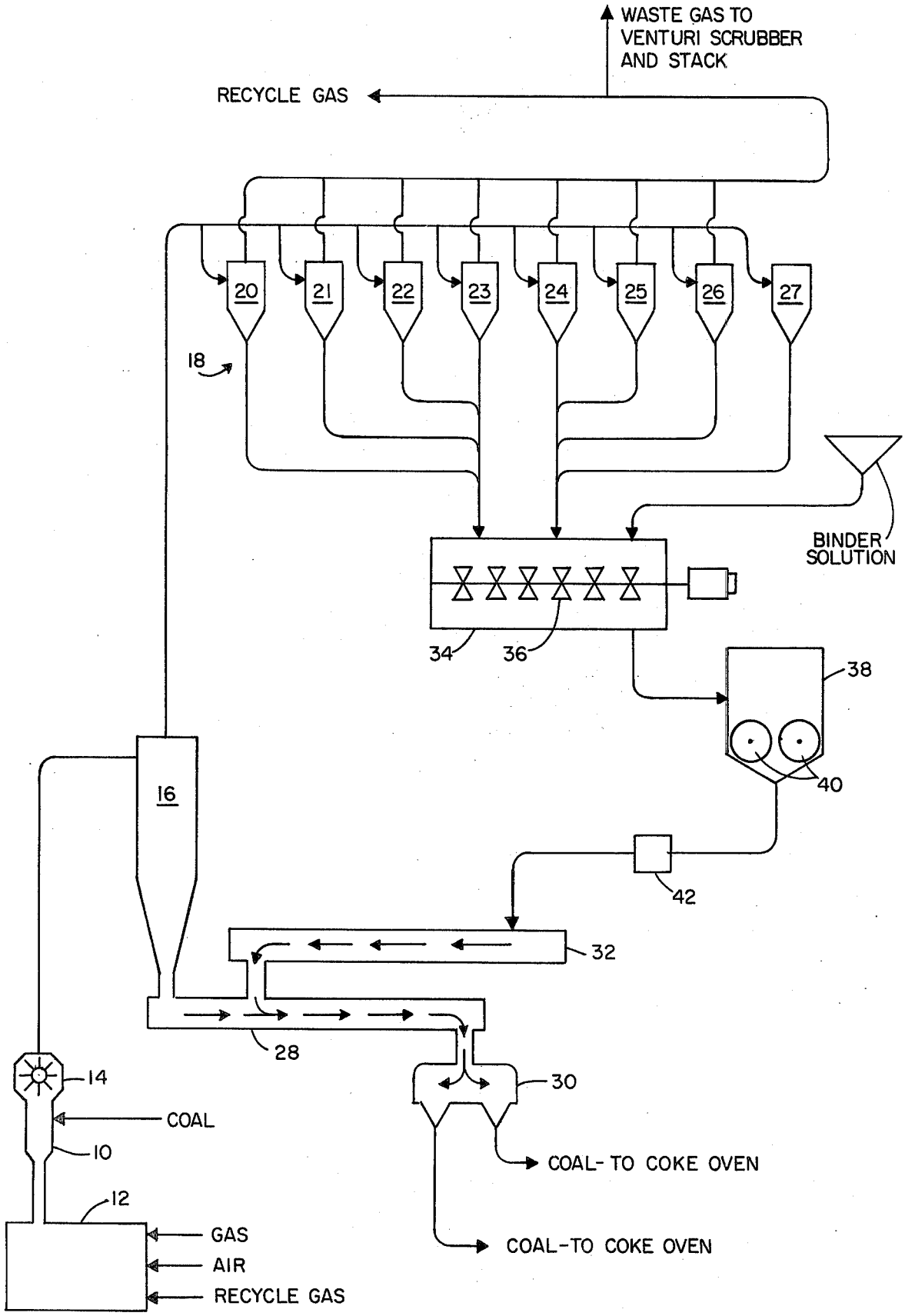
WASTE GAS TO
VENTURI SCRUBBER
AND STACK
RECYCLE GAS
20
21
22
23
24
25
26
27
18
BINDER
SOLUTION
34
36
38
40
16
42
32
28
14
30
COAL
10
COAL- TO COKE OVEN
12
GAS
AIR
RECYCLE GAS
COAL-TO COKE OVEN

METHOD AND APPARATUS FOR RECOVERING PREHEATER COAL FINES

This is a continuation of application Ser. No. 926,512, filed July 20, 1978 now abandoned.

BACKGROUND OF THE INVENTION

1. Field of the Invention

The present invention relates generally to the pipeline charging of preheated coal into coke ovens and the problems incurred by the presence of coal fines in such a system and the recovery of those coal fines.

2. Description of the Prior Art

In the known methods for controlling and recovering coal fines in a preheated pipeline coal charging system, the preheated and pressurized coal is directed firstly through a primary cyclone into which the larger particles of coal are deposited. The balance of the fluid, composed of varying sizes of coal fines and not gases, next passes through a secondary cyclone system where the bulk of the fine solids entrained in the hot gases are deposited. The hot gases, carrying less than 0.5% of the original coal charged, are then piped through a scrubber, where the balance of the entrained coal fines are removed and reclaimed.

About 90% of the coal particles are deposited in the primary cyclone with most of the balance of 10% being deposited in the secondary cyclone system. The coal deposited in the primary cyclone is almost entirely larger than 100 mesh size. The finer coal, deposited in the secondary cyclone system, is of a fine mesh ranging in size from about 100 mesh (150 microns) down to smaller than 400 mesh, with the bulk of these fines, more than 90%, being less than 325 mesh (44 microns) in size.

The coal from both the primary cyclone and the secondary cyclone system is fed into a conveyor system which, in turn, feeds the coal to a distribution bin. The coal from the distribution bin, still at an elevated temperature, is then pumped into coke ovens via pipelines. Thus the pipeline charging of the coke ovens is complete. Most of the high pneumatic pressure or steam pressure used to pump the coal through is bled off from the pipeline prior to the coke oven and is channeled to the by-product train; the balance passes through the coke oven and then into the by-product train.

Problems have developed in this system of pipeline charging. The finer particles of coal, recovered from the secondary cyclone system, develop into "carry-over" when introduced into the coke ovens as the oven is being charged. As this fine coal enters a hot coke oven, a portion of it rapidly devolatilizes into gases, causing, consequently, a high velocity in the gases that are discharged into the gas collecting system. This high exit velocity of rapidly devolitilized gases carries a larger quantity of entrained fine coal particles than is found with conventional coke oven charging systems. This increased quantity of coal fines has been found to overload the charging liquor systems of pipeline charged coke ovens. Also, the fine coal particles that are blown out of the oven are accompanied by fine tar droplets that result from the coal devolitilization. The mixture tends to compact in such places as the standpipes and the charging mains. This accumulation significantly reduces the efficiency of the coke oven by-products system and is difficult and costly to remove.

The result of these problems is a relegation of the coal fines collected in the secondary cyclone system to the status of low grade boiler fuel in an effort to eliminate fine particles of less than 100 mesh from the system. Due to the increasing scarcity of metallurgical grade coal and the commensurate increasing cost thereof, the use of that coal for low grade boiler fuel is quite uneconomical. A method for utilizing these coal fines in coking operations in a manner which eliminates the problems described previously is needed.

SUMMARY OF THE INVENTION

The present invention is directed to a method by which the coal fines from the secondary cyclone of a size of 325 mesh (44 microns) or smaller can be recovered and reintroduced into the pipeline charging system in such a form that those coal fines will not choke the coke oven off-gas system nor overload the charging liquor system. The method utilizes an advantage presented by the elevated temperature state of the coal fines in the secondary cyclone system.

Coal fines in the secondary cyclone system have a degree of elevation of temperature such that when the coal fines come into contact with liquified hydrocarbons, such as bunker C oil or coal tar, the viscosity of such fluids is reduced and an affinity of such liquids for the source of the heat is enhanced.

The coal fines are extracted from the secondary cyclone system and deposited into a means for mixing those coal fines with a liquid hydrocarbon solution. The means for mixing insures that each coal fine particle is thoroughly coated with liquid hydrocarbon which acts as a binder. Optionally, other types of binders, not hydrocarbon based, may be used, such as spent sulfite liquors from the wood processing industry.

The coated coal fines are then extracted from the means for mixing and processed through a means of compaction which squeezes the coated coal fines, forcing them to become a dense stratified mass. The coal fines become bonded together, or agglomerated.

The agglomeration of the coal fines into larger sized particles of coal produces a form which can now be reintroduced directly into the pipeline charging system at a size in excess of 100 mesh, thus eliminating the problems produced by the coal fine of less than 325 mesh. The structural integrity of the agglomerated coal fines is sufficient to prevent breakup during the pipeline charging operation, to withstand the turbulance of fluid coal pumped through the pipelines. The velocity of the off-gases from charging are equivalent to those encountered in conventional coke oven charging.

Accordingly, the principal features of this invention are the elimination of coal fine choking of the charging off-gas system and the elimination of the overloading of the charging liquor system, thus allowing the economical and efficient utilization of metallurgical grade coal fines of less than 325 mesh size in the production of coke in a pipeline charging coke oven battery.

These and other features of this invention will be more completely disclosed and described in the following specification, the methods claimed and the accompanying diagramatic drawing.

BRIEF DESCRIPTION OF THE DRAWINGS

The sole FIGURE in the drawing is an illustrated flow diagram of an embodiment of a method in accordance with the present invention.

DETAILED DESCRIPTION OF THE PREFERRED EMBODIMENT

Metallurgical grade coal, commonly used in the coke manufacturing process, is fed, usually in a wet state, into a preheater, generally designated by the numeral 10. The coal is pre-pulverized before entry into the preheater. Preheat gas is introduced into the preheater 10 from a combustion chamber, generally designated by the numeral 12, where it mixes with and preheats the coal. The preheat gas is at an average temperature of 1400° F., ranging from 1200° to 1600° F., and at an average velocity of 80 feet per second. The combustion chamber 12 is generally fired by a mixture of coke oven gas, air and recycle gas with small amounts of entrained coal dust.

The coal introduced into the preheater 10 is entrained in superheated gas from the combustion chamber 12, the combination of which produces a very turbulent fluid which serves to break up the coal by striking the particles thereof against each other. Also, the rapid flashing into steam of the water content in the coal probably causes the coal particles to literally explode, further breaking up the particles into smaller pieces.

The velocity of the preheat gas conveys the preheated coal upwardly into a disburser, generally designated by the numeral 14, which further tends to evenly distribute coal particles within the preheat gas. The preheated and sized coal particles become suspended in the preheat gas. Alternately, it is possible to eliminate the disburser, the previous mixing of the coal particles in the preheat gas being sufficient.

The velocity of the preheat gas carries the coal upwardly, through a conduit, from the disburser 14 to a primary cyclone, generally designated by the numeral 16. In the primary cyclone 16 the larger particles of coal, almost entirely larger than 100 mesh size, are separated from the gas flow to the extent that the motive preheat gas, at this point, contains only fine particles of coal dust or coal fines.

The preheat gas with entrained coal fines exits the primary cyclone 16, upwardly through a conduit, to a series of secondary cyclones or a secondary cyclone system, generally designated by the numeral 18. The individual secondary cyclones 20, 21, 22, 23, 24, 25, 26 and 27 are arranged in parallel such that most of the finer particles of coal are separated from the motive preheat gas thereby. The secondary cyclone system 18 serves to remove all but 0.5% of the entrained coal from the preheat gas.

A portion of the preheat gas, about half, mixed with a proportionate half of the 0.5% residue of the coal fines, is circulated back to the combustion chamber 12 as recycle gas. The balance of the preheat gas, along with the balance of the 0.5% residue of the coal fines, is conducted through a scrubber, not shown, where that balance of the coal fines is removed. The scrubbed gas is then expelled to the atmosphere through an exhaust stack, also not shown.

The coal particles that have been deposited in the primary cyclone 16 are metered into a primary conveyor, generally designated by the numeral 28, which transports those coal particles to a distribution bin, generally designated by the numeral 30.

The coal particles that have been deposited in the secondary cyclone system 18, about 90% of which are smaller than 325 mesh (44 microns), are metered into a mixer, generally designated by the numeral 34. An inexpensive readily available liquid hydrocarbon, such as coal tar, is also fed, in a solvent solution, into the mixer. Alternatively, non-hydrocarbon liquid can be used such as, for example, spend sulfite liquor, a waste product of the wood processing industry. The heat from the preheated coal fines serves to reduce the viscosity of the coal tar, increasing its wetability to the point where it readily coats the coal fines. The mixture of coal tar and coal fines, which gives the appearance of wet coal, is driven through the mixer by an auger, generally designated by the numeral 36. The auger 36 forces the coal-tar mixture of coal tar and coal fines into a compactor, generally designated by the numeral 38. Preferably, the compactor contains a set of smooth closely-set rolls, generally designated by the numeral 40, rotating in reverse directions and aligned parallel to each other, although briquetting, pelletizing or prilling agglomeration methods may be used. The coal-tar mixture is fed through the rolls 40 as they rotate. The rotation of the rolls 40 squeezes the coal-tar mixture, compressing the coated coal fines into a sheet. The sheet of coal fines breaks up immediately, as it exits the compactor, into chips or flakes equivalent to the coal particles already being fed into the distribution hopper 30. The size of the flakes can be varied by spacing the rolls at different distances apart and/or adding a flake-breaking disintegrator 42.

The flakes are metered into a secondary conveyor 32 which transports them into the primary conveyor 28 which, in turn, transports them to the distribution hopper 30.

All of the coal in the distribution hopper 30 is conveyed through a pipeline, under high superheated steam pressure, into coke ovens, not shown.

According to the provisions of the patent statute, the principle, the preferred method and the mode of operation of the present invention have been explained and what is considered its preferred embodiment have been illustrated and described. However, it is to be understood that, within the scope of the appended claims, the present invention may be practiced otherwise than as specifically illustrated and described.

What is claimed is:

1. In a method for pipeline charging of carbonaceous material into a coking oven, the steps of: p1 (a) feeding pre-pulverized particles of carbonaceous material into means for preheating said material;

(b) flowing superheated preheat gas, ranging from 1200° to 1600° F., through said material at a rate of flow sufficient to rapidly preheat said material while providing a turbulent fluid combination of said material and said preheat gas which serves to break up said particles of said material by means of collision and explosion thereof, within said means for preheating;

(c) entraining said broken up particles of said material, at the ambient temperature of said preheat gas, such that said broken up particles of said material are generally evenly distributed in said preheat gas, within said means for preheating;

(d) conducting upwardly, from said means for preheating, said generally evenly distributed broken up particles of said material entrained in said preheat gas, at said ambient temperature of said preheat gas;

(e) separating carbonaceous fines, sized at 100 mesh and smaller, fromthe other broken up particles of said material while maintaining said carbonaceous fines and said other broken up particles of said material at said ambient temperature of said preheat gas;

(f) separating said preheat gas from said carbonaceous fines and said other broken up particles of said material while maintaining said carbonaceous fines and said other broken up particles of said material at said ambient temperature of said preheat gas;

(g) conducting said other broken up particles of said material to a means of distribution while maintaining said other broken up particles of said material at said ambient temperature of said preheat gas;

(h) conducting said carbonaceous fines to a means of coating said carbonaceous fines with a liquid binder while maintaining said carbonaceous fines at said ambient temperature of said preheat gas;

(i) using the preheated state of said carbonaceous fines, being equivalent to said ambient temperature of said preheat gas, to promote the wetability of said liquid binder by raising the temperature of said binder, thereby equalizing the temperature of said carbonaceous fines and said liquid binder;

(j) liquid coating said carbonaceous fines with said liquid binder while maintaining said equalized temperature;

(k) conducting said liquid binder coated carbonaceous fines to a means of compacting said liquid binder coated carbonaceous fines while maintaining said equalized temperature;

(l) compacting said liquid binder coated carbonaceous fines, utilizing said means of compacting, to produce compacted carbonaceous fines;

(m) sizing said compacted carbonaceous fines to equal the size of said other broken up particles of said material, while maintaining said equalized temperature;

(n) conducting said sized compacted carbonaceous fines to said means of distribution while maintaining said equalized temperature;

(o) admixing said sized compacted carbonaceous fines to said other broken up particles of said material, said sized compacted carbonaceous fines being at said equalized temperature at the point of said admixing, said other broken up particles of said material being at said ambient temperature of said preheat gas, within said means of distribution, at said point of admixing;

(p) conducting the contents of said means of distribution, by way of pneumatically pressurized pipeline means directly to coking ovens, while maintaining said contents at the temperature that results from said admixing.

2. A method as recited in claim 1 wherein said superheated preheat gas moves at about a velocity of 80 feet per second.

3. A method as recited in claim 1 wherein said superheated preheat gas is hot combustion gas produced in a combustion chamber partially fired by recycle gas.

4. A method as recited in claim 1 wherein said separating carbonaceous fines from said other broken up particles of said material and said separating said preheat gas from said carbonaceous fines and from said other broken up particles of said material is accomplished by conducting said generally evenly distributed broken up particles of said material entrained in said preheat gas through a primary cyclone and a secondary cyclone system.

5. A method as recited in claim 1 wherein said carbonaceous material is coal.

6. A method as recited in claim 1 wherein said liquid binder is a hydrocarbon binder.

7. A method as recited in claim 6 wherein said hydrocarbon binder is a coke oven gas distillate.

8. A method as recited in claim 1 wherein said compacting of said liquid binder coated carbonaceous fines is accomplished by operation of a set of smooth rolls, arranged parallel to each other and closely spaced, rotating at equal speed in opposite directions, said space between said rolls being an area through which said liquid binder coated fuel fines are conducted.

9. A method as recited in claim 8 wherein said sizing of said compacted carbonaceous fines occurs naturally as said compacted carbonaceous fines exit said space between said rolls.

10. A method as recited in claim 8 wherein said sizing of said compacted carbonaceous fines includes further processing said compacted carbonaceous fines through a disintegrator means.

11. In combination with a process of predrying wet coal, to be charged into a coking chamber, of the type wherein the wet coal is directly contacted with a hot process gas which transports, predries and preheats the coal, wherein the predried and preheated coal is separated from the gas, and in which the separated coal is then charged into the coking chamber, the improved method of reducing the amount of fine dust in the separated gas as well as fine dust carryover comprising first separating only 80 to 90 percent of the coal from the gas without separating the fine dust thereform, then separating fine dust and the remaining coal from the gas, then compacting said separated fine dust and the remaining coal to form a compacted material, and admixing the compacted material with said first separated coal and charging said admixture into the coking chamber.

12. The improved method as set forth in claim 11, further comprising heating and admixing one of crude tar and heavy oil with said separated fine dust and the remaining coal.

13. In combination with an arrangement for predrying and preheating wet coal to be coked in a coking oven and having means for generating a high temperature process gas, means for mixing the wet coal with the process gas for predrying and preheating the wet coal, separator means connected to the predrying and preheating means for separating the gas from the predried and preheated coal, and means for conveying the predried and preheated coal to the coking oven, the improvement wherein the separator means includes a first separator for removing only 80 to 90 percent of the coal from the gas without separating the fine dust therefrom, subsequent separators connected to said first separator downstream thereof operable to separate the remaining solid matter including the fine dust, a pelletizer connected to each of said subsequent separators for receiving and pelletizing said remaining solid matter including the fine dust to form a pelletized material, means for admixing said pelletized material and said coal separated in said first separator operatively connected to the conveying means.

14. The improvement, as set forth in claim 13, further comprising means, operatively connected to said pelletizer, for admitting a binder thereto.

* * * * *